United States Patent [19]

Le Coquil et al.

[11] 4,039,881

[45] Aug. 2, 1977

[54] PLASMA DISPLAY SCREEN FOR DISPLAYING A MATRIX OF LUMINOUS POINTS

[76] Inventors: Emile F. Le Coquil, rue des Cordiers; Hubert Prigent, Batiment N 401, Kerhuel, both of Lannion, France, 22300; Guy Gerard, 1, Cite du Colombier, Perros-Guirec, France, 22700

[21] Appl. No.: 585,499

[22] Filed: June 10, 1975

[30] Foreign Application Priority Data

June 10, 1974 France ..... 74.19971

[51] Int. Cl.[2] ..... H01J 61/06

[52] U.S. Cl. ..... 313/217; 313/188

[58] Field of Search ..... 313/220, 188, 201, 217

[56] References Cited

U.S. PATENT DOCUMENTS 3,935,494 1/1976 Dick et al. ..... 313/220 X

*Primary Examiner*—Rudolph V. Rolinec

*Assistant Examiner*—Darwin R. Hostetter

[57] ABSTRACT

A gas discharge display screen with a self-scanning function is described herein. All the electrodes are positioned coplanary on a single surface of a rear insulating plate. First and second pluralities of parallel electrodes connected respectively independently accomplish respectively the scanning and displaying functions. A third plurality of parallel electrodes perpendicular to the first and second pluralities of electrodes cooperates with a particular electrode for preionizing the first gas cells of the matrix screen lines.

2 Claims, 8 Drawing Figures

PRIOR ART

PLASMA DISPLAY SCREEN FOR DISPLAYING A MATRIX OF LUMINOUS POINTS

BACKGROUND OF THE INVENTION

1. Field of the Invention

The present invention relates to a display gas discharge screen for displaying a matrix of luminous points.

More particularly, the present invention relates to a structure of a matrix of plasma cells corresponding to respective luminous points, which is self-scanned by means of a first plurality of parallel electrodes and which displays the luminous points by means of a second plurality of electrodes parallel to the first plurality of parallel electrodes, said first and second pluralities of electrodes being perpendicular to a third plurality of parallel electrodes.

2. Description of the prior art

The both essential functions, namely, scanning function and displaying function, are incorpored distinctly in the prior art display screens.

In a first prior art display screen, it utilizes the glow discharge phenomenon resulting from the application of electric fields to one or more inert gases possessing negative inpedance characteristics and, therefore, inherent momory. An initial set of signals defining a desired on/off pattern are applied to both single pluralities of electrodes. Maintenance of the resulting glows is achieved by the application of a non-information-bearing sustain signal sequence of lesser magnitude than these signals used for writing the information in the first instance.

In this end, each gas cell is defined by the intersection of both perpendicular electrodes respectively of both pluralities of electrodes. The discharge of plasma atmosphere occurs in the cell when a sufficient potential difference exists between these electrodes. Therefore, the scanning and displaying functions are achieved only with these two electrodes.

For the construction of a such screen, it is necessary to superpose a first plurality of coplanar parallel electrodes perpendicularly to a second plurality of coplanar parallel electrodes. In addition, for providing the displaying function of the screen, or the memory function, at least a dielectric substrate is positioned between these two pluralities of electrodes.

In a second prior art display screen, the scanning and displaying functions are achieved respectively with first and second pluralities of parallel electrodes and in common with a third plurality of parallel electrodes perpendicular to first and second plurality of electrodes. In this case, a cell is ionized, and its adjacent cell of the same line of cell matrix is preionized at the same time by means of scanning pulses applied between a first and a third corresponding electrodes. This preionization serves eventually at the display of the corresponding luminous point by means of displaying pulses applied between a second and a third corresponding electrodes.

As the first case, this prior art screen includes a great thickness of the screen resulting in the superposition of different pluralities of electrodes and dielectric substrats. In addition, the certain electrodes obscure the glows issued to the cells, and therefore, reduce the efficiency of the screen.

Further the superposition of electrodes requires an expensive structure of very difficult construction.

OBJECT OF THE INVENTION

Therefore, it is an object of the present invention to provide a self-scan display gas discharge screen in which all the electrodes are positioned coplanary on a single inner surface of s substrat.

Another object of the present invention is to provide a self-scan display gas discharge screen in which no electrode maskes the light issued to the gas cells.

Another object of the present invention is to provide a self-scan display discharge screen having a structure relatively simple and inexpensive.

In accordance with the aforementioned objects, the screen of the present invention is based on the processes of the second prior art screen type and comprises a rear insulating plate, on which are positioned coplanary a first and a second pluralities of spaced parallel electrodes successively alternating and a third plurality of parallel electrodes perpendicular to said first and second pluralities of electrodes.

The discharge at a cell occurs during the scanning phase when a difference potential is applied between both adjacent electrodes of the first plurality of electrodes, and during the displaying phase when a difference potential is applied between an electrode of the first plurality of electrodes and an adjacent electrode of the second plurality of electrodes. The third plurality of electrodes cooperates with a particular electrode for preionizing the first gas cells of the matrix screen lines.

DESCRIPTION OF PREFERRED EMBODIMENT

Figure 1:
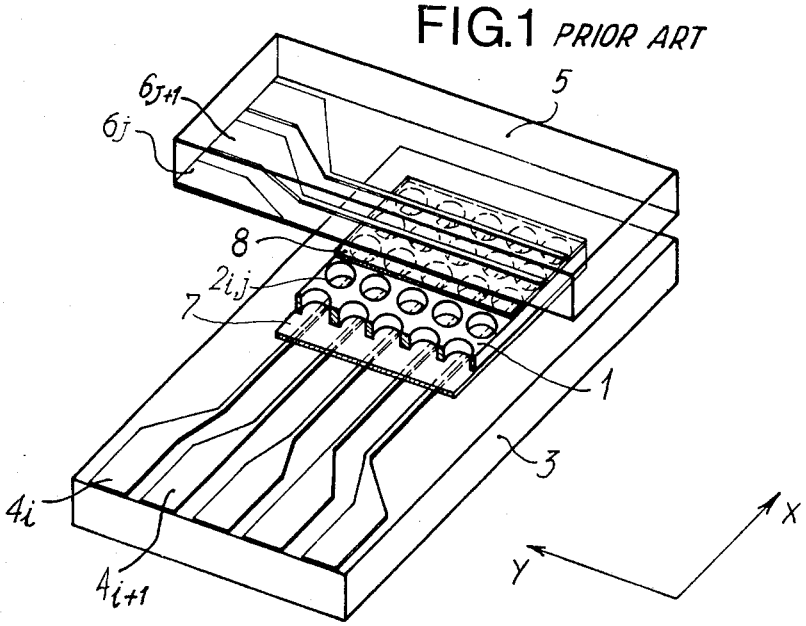
FIG.1 PRIOR ART
FIG. 1 is an exploded perspective view of a first prior art screen.

Referring to FIG. 1, it illustrates a first form of embodiment of the prior art of a plasma display screen also known as a gas discharge panel. This screen comprises essentially:

a central glass sheet 1 formed with round holes $2_{i,j}$, i = 1,2 . . . , N, and $j$ = 1,2, . . . M, composing a matrix network in X and Y directions, adapted to confine elementary volumes of gas such as neon; the thickness of this sheet and the diameter of these holes are both of the order of a few tenths of a millimetre;

a lower glass plate 3 carrying upon its upper face (as shown) an assembly of electrodes $4_i$ parallel to the X direction, with the same spacing as the holes $2_2 i, j$ and directly overlying these;

a top glass plate 5, similar to the lower plate 3 except that it carries on its lower face an assembly of electrodes $6_j$ parallel to the Y direction, with the same spacing as the holes $2_{i,j}$ and vertically above these; and, a sheet or layer of dielectric 7 which separates the sheet 1 from the plate 3, and another dielectric sheet or layer 8 separating the sheet 1 from the plate 5; thus in none of the cells around holes $2_{i,j}$ is the gas in contact with the electrodes, but only with the sheets or layers 7, 8.

Figure 2:
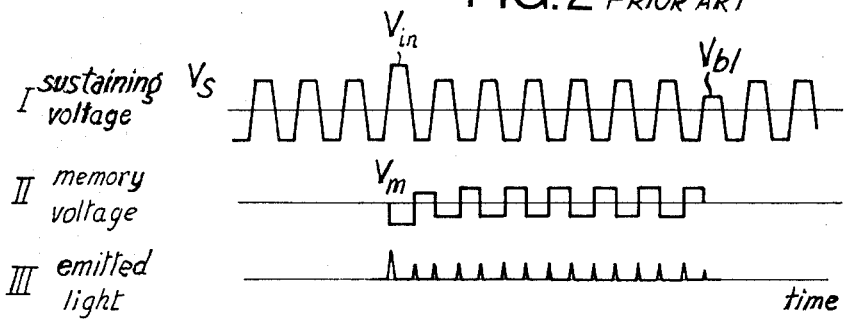
FIG.2 PRIOR ART
FIG. 2 is a diagram of the waveforms used in the screen shown in FIG. 1.
Figure 3:
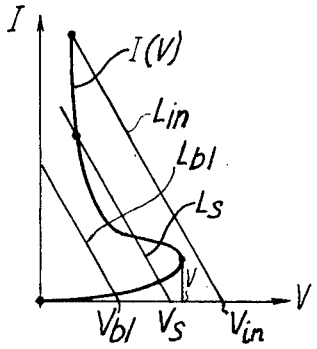
FIG.3 PRIOR ART
FIG. 3 is the characteristic graph I(V) of an elementary gas cell.

Now referring to FIGS. 2 and 3, the mode of operation of this first prior art panel is as follows. FIG. 3 illustrates the static characteristic curve I(V) of a cell corresponding to a hole $2_{i,j}$ as well as three load lines $L_{bl}$, $L_s$ and $L_{in}$ corresponding to three voltages $V_{bl}$, $V_s$ and $V_{in}$.

Taking an electrode $4_i$ of the low plate 3 and an electrode $6_j$ of the top plate 5, an alternating voltage $V_s$, called a sustaining voltage, is applied between these two electrodes, this voltage being of a high frequency (e.g. 100 kHz) and an amplitude below a value $V_t$, referred to as trigger voltage, but sufficient for the load line of the corresponding cell to the hole $2_{i,j}$ to cut its static characteristic curve I(V). At each alternation of the supply cycle the cell yields an emission of light of extremely brief duration (of the order of 200 nanoseconds) which the eye does not see (portion on the left on the three lines $L_{bl}$, $L_s$ and $L_{in}$ in the diagram of the FIG. 3).

In order to "light up" the cell in question, the crest of an alternation of the supply voltage is raised by a suitable impulse to a value $V_{in}$, known as inscription or writing value, which exceeds the trigger value $V_t$. This results in generating a $V_m$ or memory voltage between the dielectric layers. Henceforth the sustaining voltage $V_s$ results in maintaining the memory voltage $V_m$, which is regenerated with inversiton in each alternation of the supply cycle, the corresponding cell yielding at each alternation a light emission of sufficient duration to be perceptible to the eye, operating as integrator (central portion of the three lines $L_{bi}$, $L_s$ and $L_{in}$ in the diagram of the FIG. 3). In addition, the luminosity of the lit cells can be varied by altering the frequency of the applied sustaining voltage $V_{en}$.

For "extinguishing" the cell in question the crest of an alternation of the supply voltage must be lowered by a suitable pulse to a value $V_{bi}$, called blanking value, insufficient for the load line of the said cell to cut the characteristics I(V), but sufficient to cause the tension $V_m$ to disappear through the ionization of the gas. In this way the situation reverts to that preceding the despatch of the inscription pulse $V_{in}$ (right portion of the three lines $L_{bi}$, $L_s$ and $L_{in}$ in the diagram of the FIG. 3).

It must be made clear that the first ionization of the cell in question by the impulse $V_{in}$ is not possible unless there are in the gas of this cell a certain number of electric charges capable of being accelerated by the trigger field and producing a cascade (avalanche). For producing these charges some cells stay permanently illuminated, for instance, on the periphery of the panel. The light thus emitted diffuses through the cell assembly and produces electrons and ions by photo-emission on the walls.

Figure 4:
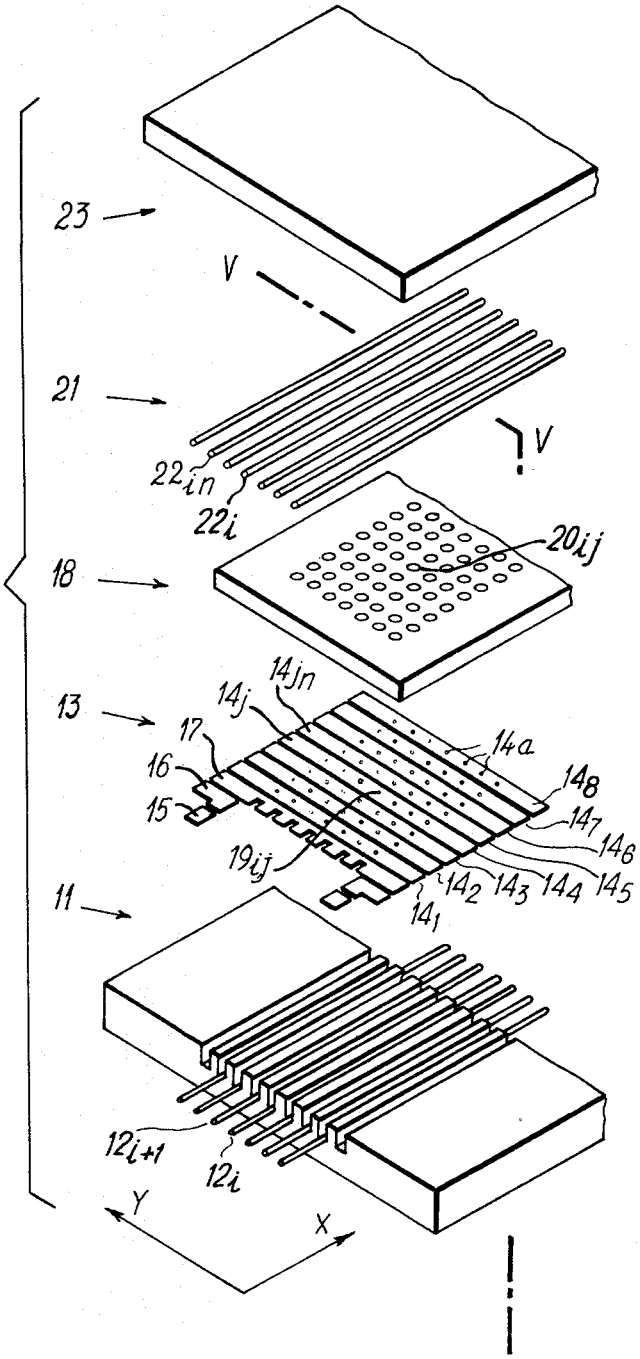
FIG. 4 PRIOR ART
FIG. 4 is an exploded perspective view of a second prior art screen.

Now referring to FIG. 4, it illustrates a second form of embodiment of the prior art termed a self-scan screen. A plasma display panel comprises essentially, in the following order:

a lower glass plate 11 carrying on its upper face coplanar assembly of rectilinear anodes $12_i$, i = 1,2, . . . , N, called scan anodes, which are parallel to the X direction and spaced by a distance *p*.

a coplanar assembly 13 of rectilinear cathodes $14_j$,j = 1,2, . . . ,M, parallel to the Y direction and spaced by a distance *p* including in addition a keep alive anode 15, a keep alive cathode 16, and a reset cathode 17; the cathodes $14_j$ are pierced by fine holes $19_{i,j}$, likewise a distance *p* apart, in lines overlying the anodes $12_i$ a central insulation plate 18, likewise perforated with holes $20_{i,j}$, but of a diameter larger than that of the aforesaid holes $19_{i,j}$, these holes $20_{i,j}$ forming a matrix with spacing *p* facing that of the holes 14*a*, the holes of one network being coaxial with those of the other;

a coplanar assembly 21 of rectilinear anodes $22_i$, called display anodes, parallel to the X direction, spaced a distance *p* apart, and overlie the scan anodes $12_1$;

finally, a transparent top glass plate 23 which forms the front of the panel.

Thus the elementary volumes of gas are substantially defined by the holes, $19_{i,j}$ and $20_{i,j}$, the gas being in contact with the scan anodes $12_i$ and display anodes $22_i$, and the tight seal being obtained by means of the outer plates 11, 23. The gas generally consists of a mixture of neon and xenon under reduced pressure (of the order of 100 to 300 torr).

The mode of operation of this second prior art panel is as follows.

The fictious lines traced, for instance on the central plate 18, by planes perpendicular to the panel and each passing through a scan anode $12_i$ and the corresponding display anode $22_i$ will be called lines; and the fictious traces on the same plate of planes perpendicular to the said lines as well as to the panel, each passing through the line of holes $19_{i,j}$ of a cathode $14_j$, will be called columns.

It is proposed to describe first how the scanning of the panel, which is generally efected simultaneously for all the lines in parallel, takes place. It is henceforth possible to consider only one of the scan anodes, $12_i$, as the process follows an identical course for every one of these anodes.

The space of the panel to scan is supplied with electric pulses of constant polarity and relatively high amplitude (constant at +250 V on the anodes and +80 V or OV on the cathodes). A initial pulse is applied between the reset cathode 17 and all the scan anodes, only one of which $12_i$ is being considered. The discharge which occurs between the reset cathode 17 and the end of the scan anode $12_i$ has the effect, through the diffusion of metastables electrons and ions, of generating in the first cell of the relevant line corresponding to the hole $19_{1,7}$ and, between the cathode $14_1$ and anode $12_i$, a space charge which serves to reduce the voltage $V_t$, required for triggering off the discharge in this first cell, to a value of $V'_t$ that is markedly below it.

At this stage it should be mentioned that a connection line (not shown) of the cathode $14_1$ is common to the cathodes $14_1$, $14_5$, $14_9$, $14_{13}$, etc., so that the total number of lines leading to the cathodes is always four only, regardless of the number of cathodes.

Nevertheless the distance betweeen the cathodes $14_1$ and $14_5$ is sufficiently great for the prionization of the first cell just mentioned corresponding to the hole $19_{i,7}$ to have no effect on the cell of range five corresponding to the hole $19_{i,5}$ and a fortiori on the others.

The first, second, third and fourth pulses are applied successively between the anode $12_i$ and the cathodes $14_1$ to $14_4$ of the range one, two, three and four respectively, each of these pulses ensuring the lighting-up of the corresonding cell and the preionization of the next one. The same process is repeated till the end of the line, whereafter the scanning, which has lasted 20 ms at most, returns to the beginning of the line.

Figure 5:
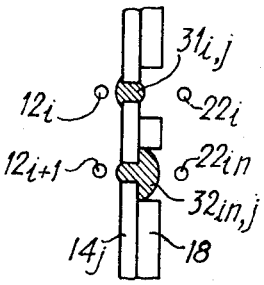
FIG. 5 is a view in partial section of the screen shown in FIG. 4, taken along the line V—V in that figure.

The glows, however, thus produced in the scan space limited to the fine holes in the cathodes, such as $\mathbf{31}_{i,j}$ from the hole $\mathbf{19}_{i,j}$ in FIG. 5, are imperceptible to the eye.

For information to appear on the panel display pulses, which are synchronized with the scan pulses but addressed to XY and of a relatively low amplitude (for example of 60 V), are applied between the cathodes 14 and the desired display anodes 22.

The glows thus created and maintained in the display space that extends over the whole width of the large holes in the plate 18, such as $\mathbf{32}_{i+1,j}$ from the hole $\mathbf{20}_{i+1,j}$ in FIG. 5, are seen by the eye.

Figure 6:
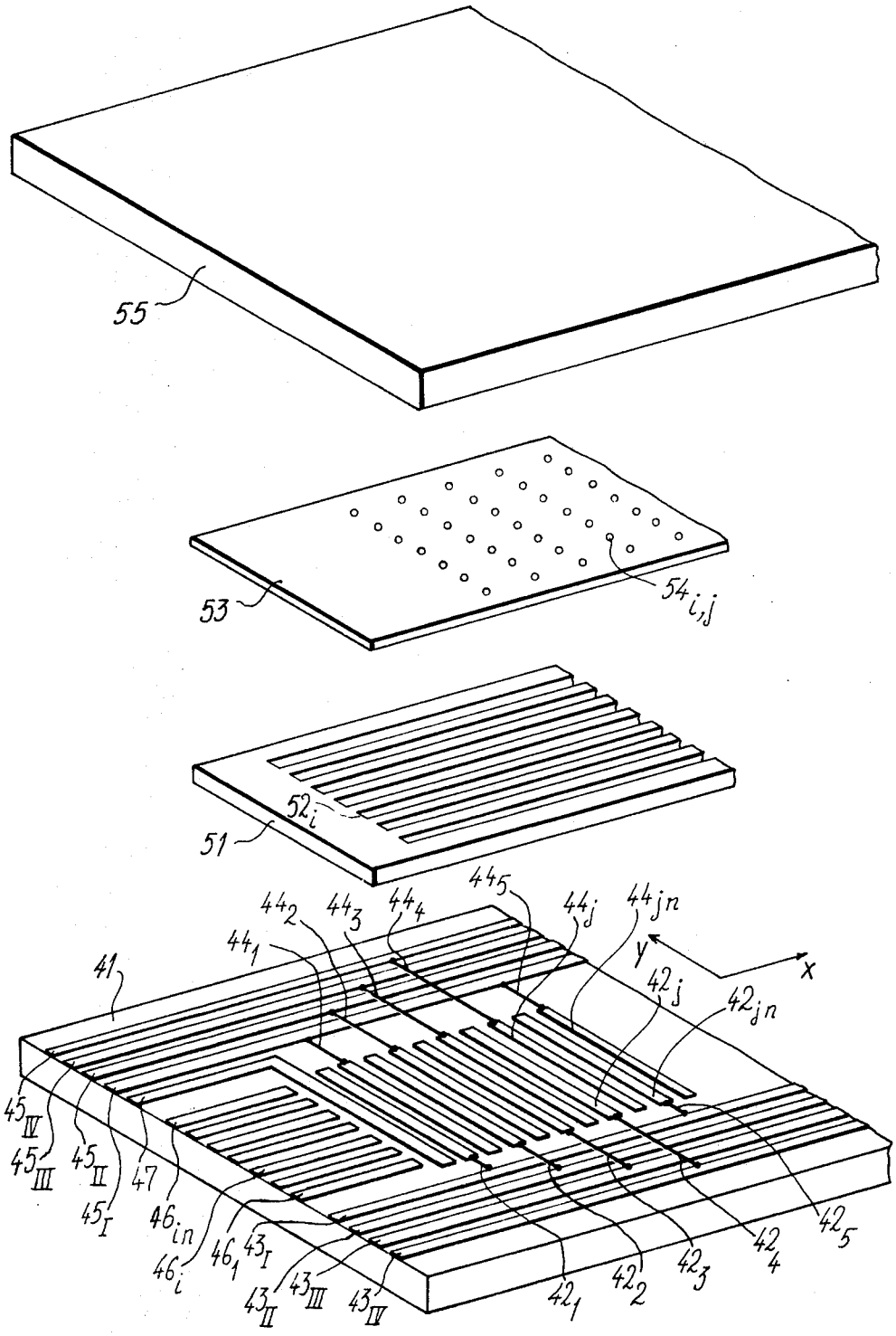
FIG. 6 is an exploded perspective view of a screen according to the invention.

A self scan display panel of the invention shown in FIG. 6 comprises:

in its rear portion a lower glass plate 41 carrying upon its upper face the assembly of all the necessary electrodes namely;

rectilinear, parallel and Y-directed scan electrodes $\mathbf{42}_j$, $j = 1, 2, \ldots, M$, spaced a distance $p$ apart. The electrodes are connected in a cyclic order to four input lines $\mathbf{43}_I$ to $\mathbf{43}_{IV}$, i.e. line $\mathbf{43}_I$ is connected to the scan electrodes $\mathbf{42}_1$, $\mathbf{42}_5$, $\mathbf{42}_9$, . . . line $\mathbf{43}_{II}$ is connected to the scan electrodes $\mathbf{42}_2$, $\mathbf{42}_6$, $\mathbf{42}_{10}$, and so on;

rectilinear, parallel and Y-directed display electrodes 44, which are likewise a distance $p$ apart but alternating with an interval $p/2$ scan electrodes $\mathbf{42}_j$, and are connected in a cyclic order to four input lines $\mathbf{42}_I$ to $\mathbf{45}_{IV}$ i.e. line $\mathbf{45}_I$ is connected to the display electrodes $\mathbf{44}_1$, $\mathbf{44}_5$, $\mathbf{44}_9$, . . . ; line $\mathbf{45}_{II}$ is connected to the display electrodes $\mathbf{44}_2$, $\mathbf{44}_6$, $\mathbf{44}_{10}$, . . . ; and so on;

rectilinear, parallel and X-directed reset anodes $\mathbf{46}_i$, $i = 1, 2, \ldots, N$, spaced by a distance $p$;

a rectilinear, Y-directed reset cathode 47 which is $p/2$ distance from the inner ends of the reset anodes $\mathbf{46}_i$;

Above the lower plate 41, the self-scan display panel of the invention comprises, in the following order:

a thin insulating sheet 51 (for instance, 0.5 mm thick) pierced with rectilinear slots 52 which are parallel to the X direction, and apaced a distance $p$ apart, cross all the electrodes $\mathbf{42}_i$ and $\mathbf{44}_i$, as well as the cathode 47, being further aligned with the anodes $\mathbf{46}_i$, whose inner ends they overlap;

a very thin insulating sheet 53 (for instance, 0.1 mm thick) pierced with a X–Y matrix of round holes $\mathbf{54}_{i,j}$ spaced a distance $p$ apart, each of these holes being directly above the intersection of the corresponding display electrode $\mathbf{44}_j$ with the corresponding slot $\mathbf{52}_i$ in the sheet 51;

a transparent top glass plate 55 forming the front of the panel.

The elementary volumes of gas cells are formed by the holes $\mathbf{54}_{i,j}$ and imaginary parallelipiped with a square base of side $p$ each inscribed into the corresponding slot $\mathbf{52}_i$ and enclosing a portion of the display electrode $\mathbf{44}_j$, as well as the a portion of the corresponding scan electrode $\mathbf{42}_j$ which precedes it, and extending to the limiting plates 41, 55. The electrodes are, therefore, in contact with the gas.

The mode of operation of the panel according to the invention is as follows.

The scanning of the lines along the slots $\mathbf{52}_i$ in the X direction takes place in series, i.e. line after line, and pulses of different voltages are fed to the electrode.

Let us assume that any line, as the line of rank i corresponding to the slot $\mathbf{52}_i$ scan triggering pulses are applied: one of +250 V to the reset anode $\mathbf{46}_i$ and the other of −50 V to the reset cathode 47, all the other electrodes being raised to +130 V. The corresponding cell, referred to as trigger cell, at the end of the line lights up and produces a preionization in the next cell, which is of rank j equal to 1 and corresponds to the slot $\mathbf{52}_i$ and the electrodes $\mathbf{42}_1$ and $\mathbf{44}_1$.

First pulses are applied: one to the scan electrode $\mathbf{42}_1$ to bring it to zero Volts and thus make it act as a cathode, the other of +250 V to the scan electrode $\mathbf{42}_2$, thus making it play the part of an anode, all the other electrodes being raised to +130 V. The cell of rank 1 lights up and produces preionozation in the cell of rank 2, which corresponds to the slot $\mathbf{52}_i$ and the electrodes $\mathbf{42}_2$ and $\mathbf{44}_2$.

Second pulses are applied: one to the scan electrode $\mathbf{42}_2$ which becomes a cathode by being brought to zero Volts, the other of +250 V to the scan electrode $\mathbf{42}_3$, which becomes an anode, all the other electrodes being brought to +130 V. The cell of rank 2 lights up and produces a preionization in the next cell, which is of rank 3 and corresponds to the slot $\mathbf{52}_i$ and the electrodes $\mathbf{42}_3$ and $\mathbf{44}_4$.

In a general manner, $j^{th}$ pulses are applied: one of O V to the scan electrode $\mathbf{42}_j$ which becomes a cathode, the other of +250 V to scan electrode $\mathbf{42}_{j+1}$, which becomes an anode, all the other electrodes being brought to +130 V. The cell of rank $j$ lights up and produces a preionization in the next cell of rank $j+1$ which corresponds to the slot $\mathbf{52}_i$ and electrodes $\mathbf{42}_{j+1}$ and $\mathbf{44}_{j+1}$.

In this way the scanning of the line of rank $i$ proceeds till its opposite end is reached. A logical control circuit (not shown) containing a pulse counter makes the scanning pass on to the next line of rank (i+1 corresponding to the slot $\mathbf{52}_{j+1}$ by causing suitable voltages to be applied to the reset cathode 47 and the reset anode $\mathbf{46}_{i+1}$ and the scanning cycle begins anew.

The glows caused by the scanning, which arise on the side of the sweeping electrodes (acting as cathodes), are invisible to the eye because the sheet 53 masks the scan electrodes.

Figure 7:
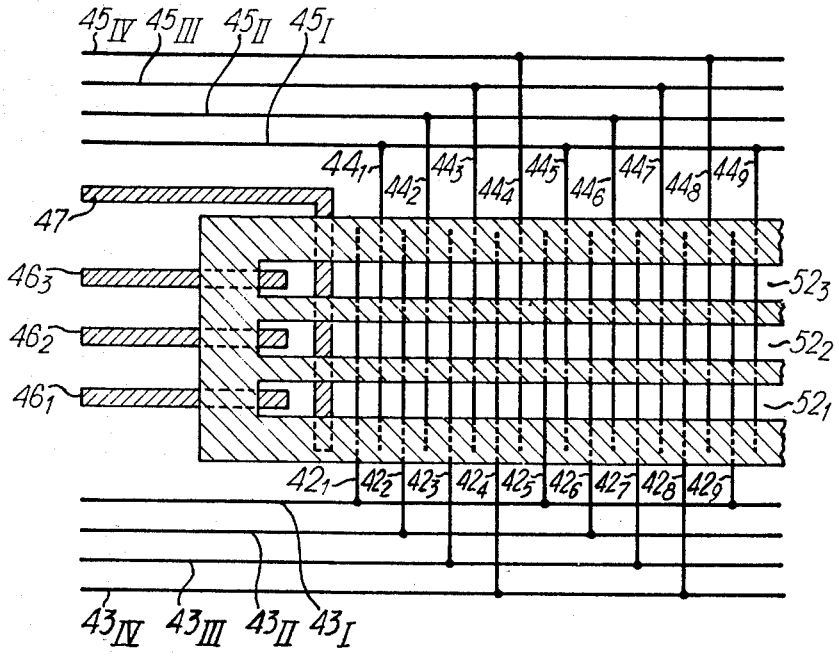
FIG. 7 is a view of details above the assembly of the plate carrying the electrodes and the sheet pierced with slots, in the case of a screen with three lines and four phase sweeping.
Figure 8:
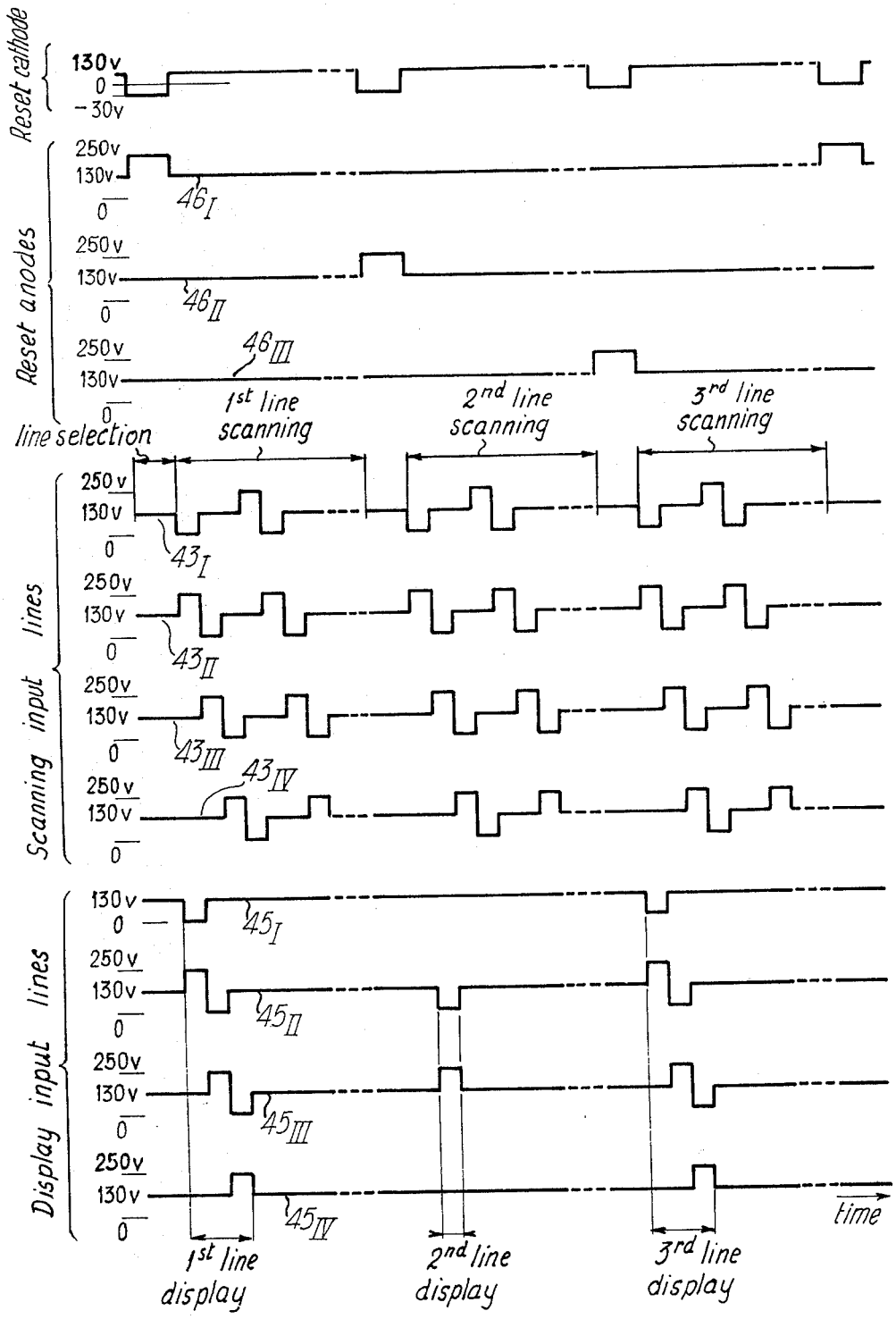
FIG. 8 is a timing diagram of the timing requirements used for the scan and display of the screen shown in FIG. 7.

The pulses necessary for the line-by-line scanning procedure thus described are illustrated in the time diagram of FIG. 8 for the case of a panel with three lines (3 slots, 3 reset anodes) and at four phases, the panel having its electrodes arranged as shown in the diagram of FIG. 7.

In order to make information appear on the panel, display pulses are sent in which are synchronized with the scanning pulses but addressed to XY. Any electrode in the display network that is not involved stays at a rest voltage of +130 V. On the other hand, at any time when a point of the panel is to be displayed it is enough to apply the same voltages (zero and +250 V) to the electrodes of the display network as to the corresponding electrodes of the same rank in the scanning network. Owing to the preionization of the corresponding elementary cell of the display network, this cell lights up during the application of the voltages, and the resulting luminous point (on the corresponding display display electrode portion side) appears through the corresponding hole in the sheet 53.

The diagram in FIG. 8 shows by way of example how the letter I comes to be displayed in three columns of the panel with three lines.

The option is reserved of modifying the luminous impression of each point displayed by acting either on the duration of the corresponding display pulse or on its amplitude.

What we claim is:

1. A display screen for displaying a matrix of luminous points, comprising:

a transparent front plate;

a first intermediate insulating plate formed with a matrix of holes arranged in N lines by M columns;

a second intermediate insulating plate having N slots each aligned with a respective line of holes in said first intermediate plate;

a back insulating plate supporting on its inner surface a plurality of electrodes;

said plurality of electrodes including M parallel sweeping electrodes each parallel to a respective column of holes and spaced apart by a distance equal to the distance between said columns of holes;

said plurality further including M parallel display electrodes arranged parallel to and alternating with said sweeping electrodes;

each display electrode cooperating with a respective column of holes;

a set of sweeping bus bars connected to said M sweeping electrodes in a cyclic order;

a set of display bus bars connected to said M display electrodes in a cyclic order;

a fly-back cathode parallel to and adjacent the first sweeping electrodes;

a set of N fly-back anodes respectively communicating with said N slots in a said second intermediate plate and arranged adjacent said fly-back cathode on side of said cathode remote from said sweeping electrodes; and an ionizable gas atmosphere under low pressure filling the spaces defined by said slots and said holes.

2. A display screen as claimed in claim 1 wherein said M sweeping parallel electrodes and said M display electrodes are substantially coplanar.

* * * * *